US009032978B2

(12) United States Patent
Kiechle et al.

(10) Patent No.: US 9,032,978 B2
(45) Date of Patent: May 19, 2015

(54) DISHWASHER WITH A DAMPING DEVICE AND METHOD FOR PRODUCING A DAMPING DEVICE

(75) Inventors: Franz Kiechle, Günzburg (DE); Karlheinz Rehm, Dischingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 886 days.

(21) Appl. No.: 13/108,159

(22) Filed: May 16, 2011

(65) Prior Publication Data

US 2011/0297193 A1 Dec. 8, 2011

(30) Foreign Application Priority Data

Jun. 7, 2010 (DE) ..... 10 2010 029 731

(51) Int. Cl.
*A47L 15/42* (2006.01)
*A47L 15/50* (2006.01)

(52) U.S. Cl.
CPC ..... *A47L 15/507* (2013.01); *Y10T 29/49826* (2015.01); *Y10T 29/4998* (2015.01)

(58) Field of Classification Search
CPC ..... A47L 15/507; A47B 2210/17; A47B 2210/0059; A47B 2210/091; A47B 88/044; F04B 1/0421; F04B 53/003; F04B 53/166; E05F 3/102; F25D 25/025; F16F 9/469
USPC ..... 312/334.8, 228, 334.44, 334.1, 330.1; 134/137, 165; 29/428, 527.1
See application file for complete search history.

(56) References Cited

U.S. PATENT DOCUMENTS

| | | | | |
|---|---|---|---|---|
| 5,535,514 | A * | 7/1996 | Lucas | 29/888.06 |
| 2004/0163687 | A1 | 8/2004 | Son et al. | |
| 2007/0215186 | A1 | 9/2007 | Kim | |
| 2008/0210272 | A1 | 9/2008 | Kaczmarek | |
| 2010/0051067 | A1 * | 3/2010 | Dalsing | 134/46 |

FOREIGN PATENT DOCUMENTS

| | | | |
|---|---|---|---|
| DE | 29902915 | U1 | 7/2000 |
| DE | 102007025966 | A1 * | 11/2008 |
| EP | 1195129 | A1 | 4/2002 |

OTHER PUBLICATIONS

English Machine Translation of Description of DE 102007025966 A1 (Hennecke et al., 2008).*
European Search Report EP 11 16 7213, Date: Jul. 2, 2012.

* cited by examiner

*Primary Examiner* — Michael Barr
*Assistant Examiner* — Irina Graf
(74) *Attorney, Agent, or Firm* — James E. Howard; Andre Pallapies

(57) ABSTRACT

A dishwasher includes a washing compartment, at least one dishware container, and a guide assembly to allow the dishware container to be moved out of the washing compartment and into the washing compartment. The movement of the dishware container in relation to the washing compartment is cushioned by at least one damping device which is arranged inside the washing compartment.

12 Claims, 2 Drawing Sheets

DISHWASHER WITH A DAMPING DEVICE AND METHOD FOR PRODUCING A DAMPING DEVICE

BACKGROUND OF THE INVENTION

The invention relates to a dishwasher having a damping device and to a method for producing a damping device.

DE 10 2005 010 616 A1 discloses a dishwasher having a washing compartment in which are arranged two dish racks for accommodating food-soiled items requiring to be cleaned. The dish racks can be moved out of the washing compartment and into the washing compartment by means of suitable guides and a drive. The drive can include an electric motor or be embodied as an energy accumulator. If an energy accumulator is used as a drive, the movement introduced by means of the energy accumulator can be damped at least in the final phase of the movement with the aid of a damping means.

BRIEF SUMMARY OF THE INVENTION

It is an object of the invention to disclose an improved dishwasher, in particular a domestic dishwasher comprising a dishware container to which a damping device is assigned.

The object of the invention is achieved by means of a dishwasher having a washing compartment, at least one dishware container which can be moved out of the washing compartment and into the washing compartment by means of guides, and at least one damping device for damping a movement of the dishware container, wherein the damping device is arranged inside the washing compartment. The dishwasher according to the invention is in particular a domestic dishwasher. Because the damping device is arranged inside the dishwashing compartment it can for example be installed relatively easily. Furthermore the washing compartment provides more space than for example the constricted conditions e.g. behind the rear wall of the washing compartment. Arranging the damping device inside the washing compartment also enables the damping device to be coupled more effectively to the dishware container in order to cushion the movement of the latter.

Preferably the damping device is arranged in or secured to the washing compartment, in particular on a side wall of the washing compartment.

According to a variant of the inventive dishwasher the damping device has a piston and a cylindrical housing which encloses a compression chamber, with the at least one piston being movably mounted inside the housing and dividing the compression chamber into compression sub-chambers. The fluid contained in the compression chamber, which fluid is preferably air, but also can at least partly include water or a dishwashing detergent for cleaning the food-soiled items to be cleaned by means of the dishwasher, causes the piston's movement to be cushioned when the piston is displaced, thereby producing the damping effect of the damping device.

In order to enable the fluid contained within the housing to flow from one compression sub-chamber to the other while the piston is being displaced inside the housing, the piston can preferably have at least one aperture through which the fluid contained inside the housing flows from one compression sub-chamber to the other compression sub-chamber when the piston is displaced. The aperture is embodied for example as a bore hole, in particular as a throttling port. It can also be implemented in the shape of a slot. It is also possible for the aperture, in particular if it is slot-shaped, to be embodied as open-edged.

The housing can preferably have the shape of a circular cylinder and/or the shape of a straight cylinder. These shapes can be manufactured relatively easily.

A spring can be arranged in at least one of the compression sub-chambers in order to increase the effect of the damping device.

The piston can be arranged so as to be movable inside the housing preferably in a positive-locking manner. This likewise increases the damping effect of the damping device.

According to one variant the damping device of the dishwasher according to the invention is secured with its housing to the washing compartment, in particular on a side wall of the washing compartment. In order to facilitate its attachment a fastening device integrally moulded on the housing can be provided by means of which the damping device is secured to the washing compartment. The fastening device is implemented e.g. as a mounting plate.

The damping device can preferably have a piston rod on which the at least one piston is arranged, with the at least one piston being mounted inside the housing so as to be movable by means of the piston rod. The piston rod can be coupled e.g. to the dishware container in order to cushion the movement of the latter.

According to a preferred embodiment variant of the inventive dishwasher the housing of the damping device is provided on each of its end faces with an opening through which the piston rod projects. It is therefore possible for the piston to be displaced in two opposing directions inside the housing e.g. simply by pressing on the piston rod. This enables e.g. a movement of the dishware container to be cushioned in both directions.

According to a preferred variant of the inventive dishwasher the latter has two stops which are arranged on the dishware container and/or on the latter's guides and between which the damping device is arranged in the washing compartment in such a way that said stops interactively cooperate with the piston rod such that one of the delimiters pushes the piston rod in a first direction when the dishware container is moved out of the washing compartment and the other of the delimiters pushes the piston rod in a direction opposite to the first direction when the dishware container is moved into the washing chamber.

Thus, each time the dishware container is moved out, e.g. when it is manually withdrawn, from the washing compartment the piston is automatically displaced inside the housing by means of the relevant stop and the piston rod in such a way that when the dishware container is moved into the washing compartment, in particular when it is pushed in by hand, the piston rod hits the relevant stop and thereby displaces the piston inside the housing. As a result the damping device can achieve its damping effect every time the dishware container is moved in and in particular cushion the movement of the dishware container anew every time it is moved in.

According to an advantageous embodiment variant the damping device is made at least in part, preferably completely, of plastic in order at least to preclude the risk of its being exposed to corrosion. In particular the housing, the piston and where appropriate the piston rod are made of plastic.

According to a beneficial variant of the inventive dishwasher, in order to allow relatively easy assembly and installation of the damping device the housing can comprise two part-housings, each of which in particular has the shape of a semi-cylinder.

Thus, one aspect of the invention provides an advantageous method for producing a damping device for the inventive dishwasher, according to which method the piston rod is placed into one of the two semi-cylindrical part-housings such that the piston is arranged in said part-housing. The two part-housings are then joined together, thereby creating the housing.

The two part-housings are preferably adhesively bonded to each other and/or mechanically locked together. This enables the joining-together of the two part-housings to be accomplished in a relatively simple manner.

Accordingly, the invention advantageously provides in particular an end position damper for dishware containers which are embodied e.g. as dish racks. The damping device can in particular comprise a damper housing which can be assembled from two halves, at both ends of which there is embodied in particular a fit bore through which a piston rod is movable on both sides. In the middle of the piston rod there can preferably be disposed one or more baffle plates, generally pistons e.g. with a throttling port, which are preferably installed in a positive-locking manner in the compression chamber of the damper housing. The piston rod is displaced in one direction e.g. by means of a plate on the rack guide or on the dish rack. The air contained on one side in the compression chamber where necessary flows through the throttling port of the baffle plate into the opposite compression space of the damper housing. The resulting damper effect can where necessary be reinforced by means of springs additionally introduced into the compression space. After the piston rod has been inserted, the damper housing is sealed if necessary e.g. by means of adhesive bonding and/or mechanical locking and secured to the container for example by means of an extruded mounting plate.

An advantage of the dishwasher according to the invention can be in particular that e.g. the dishware container does not abruptly jolt to a halt at the end stop of the dishware container guide. A risk that items of dishware will fall over can therefore be at least prevented, if not avoided altogether. Haptic feedback for an operator of the dishwasher according to the invention can likewise be improved.

BRIEF DESCRIPTION OF THE DRAWINGS

Other developments of the invention are set forth in the dependent claims. The invention and its developments as well as their advantages are explained hereinbelow with reference to schematic drawings, in which:

DETAILED DESCRIPTION OF EXEMPLARY EMBODIMENTS OF THE PRESENT INVENTION

Figure 1:
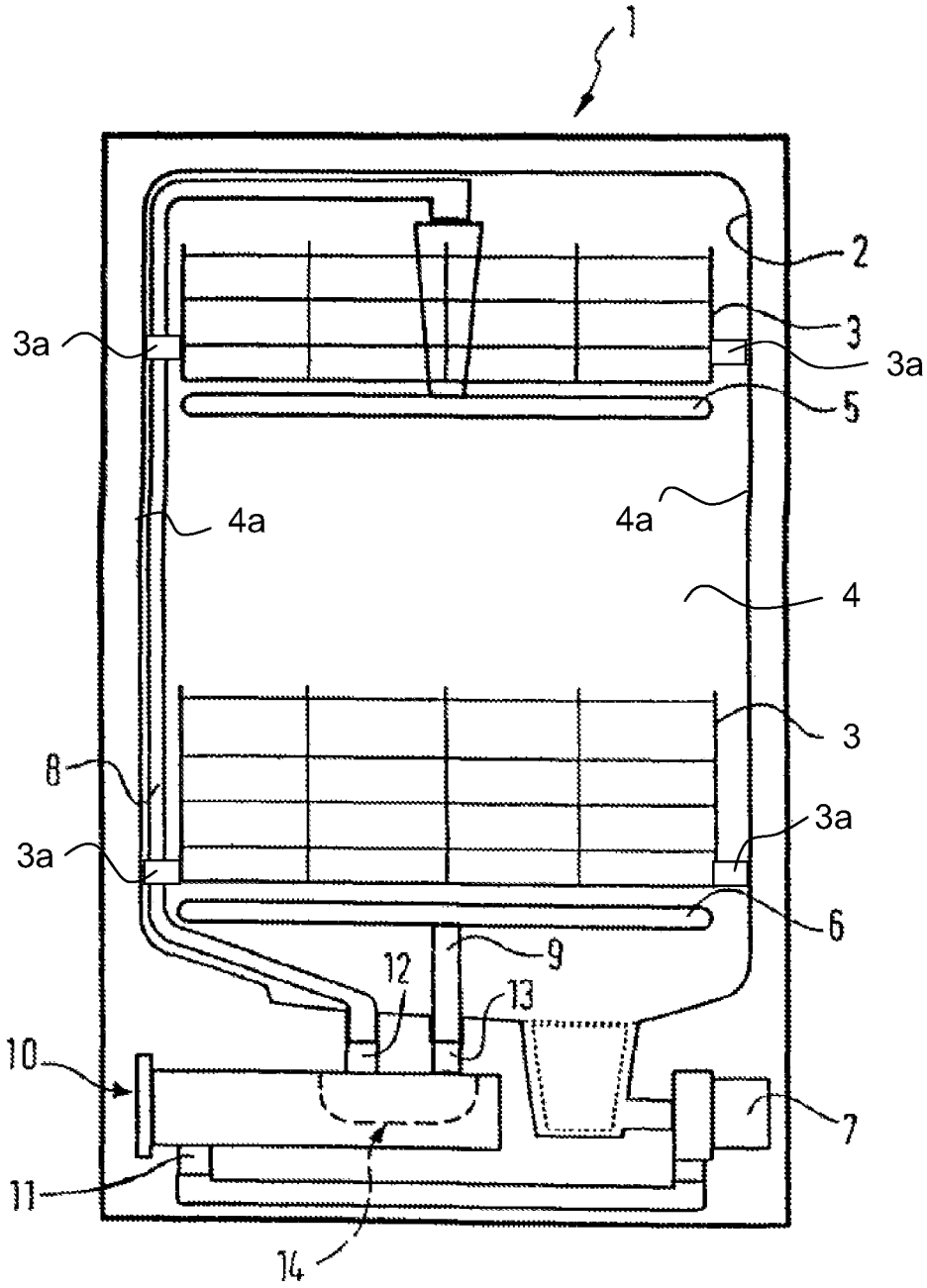
FIG. 1. shows a domestic dishwasher.
Figure 2:
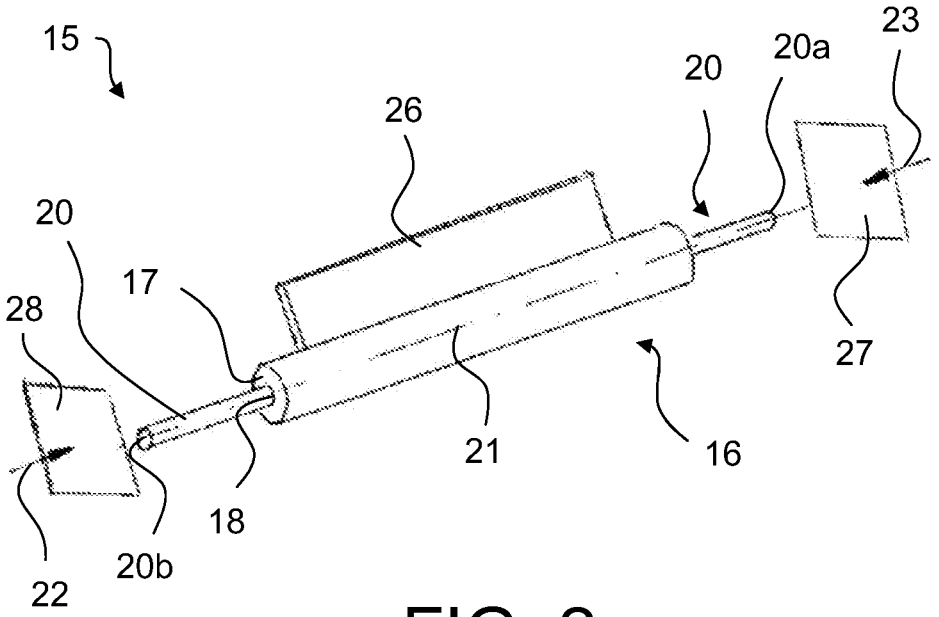
FIG. 2 shows an advantageous exemplary embodiment of an inventively designed damping device for a dish rack of the domestic dishwasher.
Figure 3:
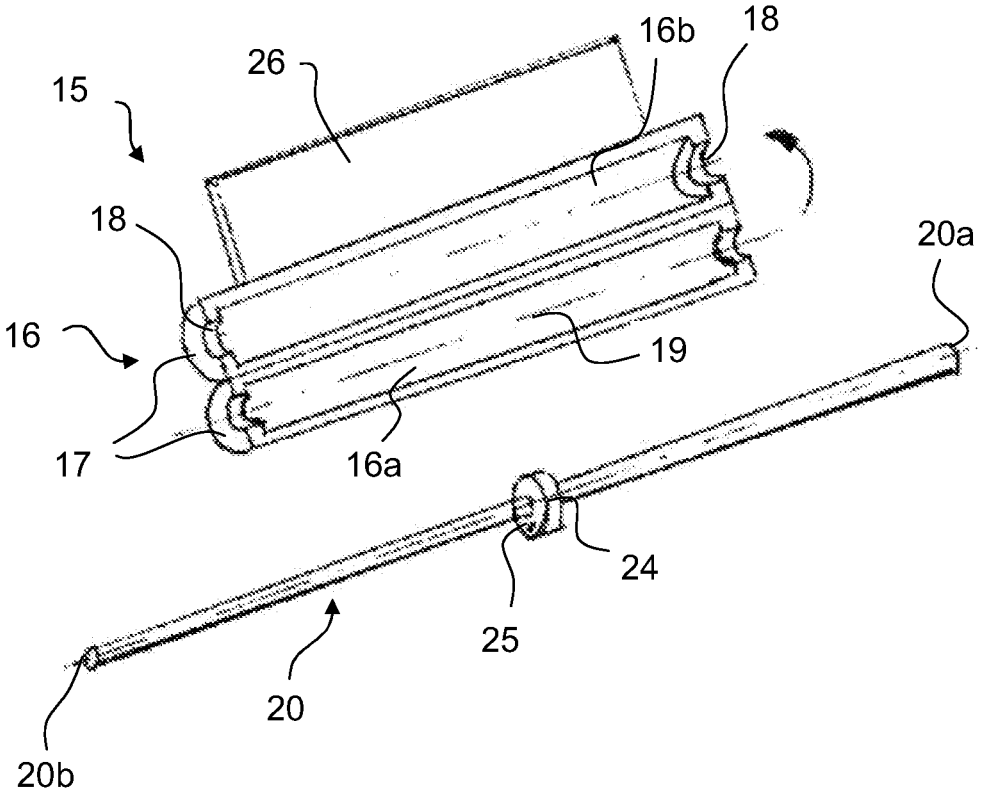
FIG. 3 shows components of the damping device.

Elements with like function and mode of operation are labelled by the same reference signs in each of FIGS. 1 to 3.

FIG. 1 shows a sectional view of a domestic dishwasher 1 as an example of a dishwasher.

The domestic dishwasher 1 has a washing compartment 2 for accommodating food-soiled items which can be sorted for example into dishware containers arranged vertically one above the other and embodied as dish racks 3. The washing compartment 2 has two side walls 4*a* and a rear wall 4 and can be closed in the customary manner by means of a door (not shown in further detail) which can be pivoted relative to a horizontal axis. With the door open the two dish racks 3 can be withdrawn out of the washing compartment 2 by means of guides 3*a* in order at least to facilitate loading and unloading of the dish racks 3. The dish racks 3 can also be inserted into the washing compartment 2 by means of the guides 3*a*.

Arranged in the washing compartment 2 are for example at least two spray devices for spraying the food-soiled items to be cleaned with a liquid which is generally referred to as wash liquor. In the case of the present exemplary embodiment the spray devices are embodied as upper and lower spray arms 5, 6. The liquid can be conveyed by a circulating pump 7 via a first liquid supply line 8 to the upper spray arm 5 and via a second liquid supply line 9 to the lower spray arm 6. The circulating pump 7 is driven e.g. by means of an electric drive (not shown in further detail), in particular by means of its electric motor.

In the case of the present exemplary embodiment the liquid is heated at least in a subprogram step of a wash program of the domestic dishwasher 1 by means of a continuous-flow heater 10 which is connected by means of an inlet connecting piece 11 to the circulating pump 7 and by means of outlet connecting pieces 12, 13 to the liquid supply lines 8, 9. The number of outlet connecting pieces 12, 13 corresponds to the number of spray arms 5, 6 or simultaneously operated groups of spray arms 5, 6. In the case of the present exemplary embodiment the liquid conveyed by the circulating pump 7 is accordingly delivered to the inlet connecting piece 11 of the continuous-flow heater 10 and from its outlet connecting pieces 12, 13 via the liquid supply lines 8, 9 to the spray arms 5, 6.

The domestic dishwasher 1 additionally has a water diverter 14 which is arranged e.g. in the continuous-flow heater 10 or integrally moulded on the latter. Alternatively the water diverter 14 can also be arranged separately e.g. in the domestic dishwasher 1 or be connected directly to the circulating pump 7.

By means of the water diverter 14 the spray arms 5, 6 can each be charged in alternation and/or constantly with the liquid, which is achieved by opening one liquid outlet and by closing another liquid outlet of the water diverter 14.

In order to cushion an impact of the dish racks 3 against the rear wall 4 of the washing compartment 2 when the dish racks 3 are pushed into the washing compartment 2, each of the dish racks 3 is provided with a damping device 15 as shown in FIGS. 2 and 3. FIG. 2 shows the damping device 15 in a perspective view and FIG. 3 shows components of the damping device 15.

In the case of the present exemplary embodiment the damping device 15 has a hollow cylindrical damper housing 16. The damper housing 16 has in particular the shape of a straight cylinder and preferably has the shape of a circular cylinder. The two end faces of the damper housing 16 are delimited by walls 17, each of which is provided with an opening 18 which is embodied in particular as a fit bore. The damper housing 16 therefore encloses a compression chamber 19. The damper housing 16 is made e.g. of plastic or metal.

In the case of the present exemplary embodiment the damping device 15 has a piston rod 20 which is passed through the openings 18 in the walls 17 of the damper housing 16 and consequently projects from the damper housing 16 on both sides. The size of the openings 18 is geared to the dimensions of the piston rod 20. The piston rod 20 can therefore be displaced along the longitudinal axis 21 of the damper housing 16 in the direction of arrows 22, 23. The piston rod 20 is made e.g. of plastic.

In the case of the present exemplary embodiment the damping device 15 comprises at least one piston which is embodied e.g. as a baffle plate or disc 24 which is attached to the piston rod 20, in particular integrally moulded thereon in one piece, preferably made of one material. The plate 24 is implemented in such a way that it divides the compression chamber 19 into two compression sub-chambers whose size is dependent on the position of the piston rod 20 and consequently on the position of the plate 24 relative to the damper housing 16. The plate 24 is inserted in the compression chamber 19 in a positive-locking manner. To enable air or a fluid, e.g. water, to pass from one compression sub-chamber to the other during an axial movement of the piston rod 20 and hence of the plate 24, i.e. during a longitudinal movement of the piston rod 20 or of the plate 24, the plate 24 is provided with at least one aperture 25 or, as the case may be, with at least one throttling port. The aperture 25 can be embodied as round or slot-shaped or else as open-edged.

In order to assemble the damping device 15, the damper housing 16 can be constructed in two parts, as is provided in the present exemplary embodiment, and comprise two semi-cylindrical part-housings 16*a*, 16*b*. For assembly, the piston rod 20 with plate 24 affixed thereto is placed into one of the two part-housings 16*a*, 16*b* and then the two part-housings 16*a*, 16*b* are joined together, e.g. by adhesive bonding or mechanical locking.

In the case of the present exemplary embodiment the damping device 15 is fixed with its damper housing 16 to one of the side walls 4*a* of the washing compartment 2, e.g. by means of a mounting plate 26 which is e.g. extruded on the damper housing 16. The damping device 15 is attached to the washing compartment 2 in particular in such a way that the longitudinal axis 21 of the damper housing 16 is aligned horizontally, i.e. parallel to the insertion direction of the respective dish rack or, expressed in general terms, dishware container and consequently runs parallel in the depth direction of the washing compartment.

If the relevant dish rack 3 to which the damping device 15 is assigned is now e.g. withdrawn from the washing chamber 2, one of the ends 20*a* of the piston rod 20 will then e.g. hit a first stop which is embodied e.g. as a first plate 27 which is attached e.g. to the relevant dish rack 3 or to its guide 3*a*. This causes the piston rod 20 to be displaced relative to the damper housing 16 in the direction of the arrow 23.

If the respective or relevant dish rack 3 is pushed into the washing compartment 2, the other end 20*b* will then hit e.g. a second stop which is embodied for example as a second plate 28 which is attached e.g. to the relevant dish rack 3 or to its guide 3*a*. This causes the piston rod 20 and hence the plate 24 to be displaced relative to the damper housing 16 in the direction of the arrow 22. Owing to the displacement of the plate 24 air or, as the case may be, water passes through the aperture 25 in the plate 24 from one of the compression sub-chambers to the other, thereby resulting in a damping effect on the part of the damping device 15. This acts as a brake on the movement of the dish rack 3 when the latter is pushed into the washing chamber 2 as the end 20*b* of the piston rod 20 comes into contact with the second plate 28.

The damping effect of the damping device 15 can be reinforced further if at least one of the two compression sub-chambers is provided with a spring (not shown in further detail). Thus, it is e.g. possible to provide a pressure spring in the compression sub-chamber which is formed by means of the plate 24 of the piston rod 20 and the wall 17 that faces away from the rear wall 4 of the washing compartment 2.

What is claimed is:

1. A dishwasher, comprising:

a washing compartment;

at least one dishware container;

a guide assembly to allow movement of the dishware container in and out of the washing compartment;

at least one damping device for cushioning the movement of the dishware container in relation to the washing compartment, said damping device being arranged inside the washing compartment, wherein the damping device has a piston and a cylindrical housing which encloses a compression chamber, said piston being movably mounted inside the housing and dividing the compression chamber into compression sub-chambers, wherein the damping device has a piston rod on which the piston is arranged, the piston rod comprising two opposite ends located outside the housing, said piston being mounted inside the housing and movable by the piston rod; and two stops arranged at least on one of the dishware container and the guide assembly, said damping device being arranged between the stops on the washing compartment in such a way that when the dishware container is moved out of the washing compartment, the one end of the piston rod hits one of the stops that pushes the piston rod in a first direction, and when the dishware container is moved into the washing compartment, the other end of the piston rod hits the other of the stops that pushes the piston rod in a second direction opposite to the first direction.

2. The dishwasher of claim 1, constructed as a domestic dishwasher.

3. The dishwasher of claim 1, wherein the damping device is arranged on a side wall of the washing compartment.

4. The dishwasher of claim 1, wherein the piston has at least one aperture for passage of a fluid contained within the housing from one of the compression sub-chambers to another one of the compression sub-chambers when the piston is displaced.

5. The dishwasher of claim 1, wherein the damping device is made at least partly of plastic.

6. The dishwasher of claim 1, wherein the damping device is made completely of plastic.

7. The dishwasher of claim 1, further comprising a spring arranged in at least one of the compression sub-chambers.

8. The dishwasher of claim 1, wherein the housing is secured to the washing compartment.

9. The dishwasher of claim 6, further comprising a fastening member which is integrally moulded on the housing for securing the damping device to the washing compartment.

10. The dishwasher of claim 1, wherein the housing of the damping device is secured to a side wall of the washing compartment.

11. The dishwasher of claim 1, wherein the housing of the damping device has end faces, each provided with an opening for traversal of the piston rod.

12. The dishwasher of claim 1, wherein the housing of the damping device is two part-housing, and the two parts are adhesively bonded to each other and/or mechanically locked together to form the housing.

* * * * *